United States Patent [19]

Limberger et al.

[11] Patent Number: 4,893,949

[45] Date of Patent: Jan. 16, 1990

[54] DISTANCE ADJUSTER FOR A PRINT HEAD OF AN OFFICE MACHINE

[75] Inventors: Alois Limberger, Grüningen; Berhard Nolte, Villingen; Dieter Stellmach, Bad Dürrheim, all of Fed. Rep. of Germany

[73] Assignee: Mannesmann Aktiengesellschaft, Düsseldorf, Fed. Rep. of Germany

[21] Appl. No.: 161,916

[22] Filed: Feb. 29, 1988

[30] Foreign Application Priority Data

Feb. 28, 1987 [DE] Fed. Rep. of Germany ..... 3706573

[51] Int. Cl.[4] ..... B41J 11/20

[52] U.S. Cl. ..... 400/56; 400/59

[58] Field of Search ..... 400/55, 56, 57, 58, 400/59, 352, 355, 356

[56] References Cited

U.S. PATENT DOCUMENTS

| | | | |
|---|---|---|---|
| 3,904,010 | 9/1975 | Krauss et al. | 400/56 |
| 4,024,940 | 5/1977 | Hendrischk et al. | 400/56 |
| 4,420,269 | 12/1983 | Ackermann et al. | 400/356 |

OTHER PUBLICATIONS

"Automatic Retraction of Print Head Carrier Band"; F. R. Humphreys; *IBM Technical Disclosure Bulletin;* vol. 25, No. 9, Feb. 1983; pp. 4677–4678.

*Primary Examiner*—David A. Wiecking
*Attorney, Agent, or Firm*—Horst M. Kasper

[57] ABSTRACT

The print head (9) disposed on a print-head carriage (8) can be moved back and forth parallel to a print support (13) between end positions (8*a*, 8*b*) and can be set perpendicular to the print-surface support (13) against a spring force of, for example, a leg spring (14) relative to the print surface support (13) in the context of a device for the setting of the distance of a print head (9) on a thick print material (10) in an office machine, in particular in a printer for savings booklets or vouchers.

In addition, at least one rotatable roller (15), supported at the print-head front face (9*a*), is provided, which roller rests on a bendable strip (16) running in parallel to the print surface support (13), where the bendable strip (16) rests solidly on the thick printing material (10) during the printing process. In order to be able to process a print material which is several millimeters thick with respect to the insertion and removal and with providing a line-feed switching without interference, it is disclosed that the bendable strip (16) is longitudinally movable attached under tension spring force, where the print-head carriage (8) can be lifted in sections (30, 31) of its end positions (8*a*, 8*b*) and where cutout sections (32, 33) are disposed in the bendable strip (16), where a rotatable roller submerges into the cutout sections (32, 33).

20 Claims, 6 Drawing Sheets

DISTANCE ADJUSTER FOR A PRINT HEAD OF AN OFFICE MACHINE

BACKGROUND OF THE INVENTION

1. Field of the Invention

The invention relates to a device for the setting of distances of a print head on a thick print material in an office machine, in particular in a printer for savings booklets and vouchers, where the print head can be moved back and forth on a print-head carriage in parallel to a print surface support between end positions and can be set perpendicular to the print surface support against the spring force relative to the print surface support, with at least one rotatable roller supported at the print-head front face, which roller rests on a bendable strip running in parallel to the print-surface support, where the bendable strip solidly rests on the thick print material during the printing process.

2. Brief Description of the Background of the Invention Including Prior Art

Such a device is known from the German Patent Application Laid Open DE-AS 2,234,616. The known device serves for sensing distance in the context of an automatic distance control between a print head and the paper to be printed on. The known device is to solve the problem of creating a paper-thickness sensing device at printers, which allows to achieve with simple means an automatic adaptation of the distance print head - paper to various paper thicknesses and which does not render the introduction of record carriers difficult. Such a device, however, can only provide advantages as a distance-setting device with several paper layers, however it is not advantageous in case of print material thicknesses, which amount to from about 0.3 and more millimeter to several millimeters.

SUMMARY OF THE INVENTION

1. Purposes of the Invention

It is an object of the present invention to provide a distance setting for thick print materials in the context of dot-matrix printers.

It is another object of the present invention to provide a distance adjustment means for impact printers, where both the insertion and placing of the print material, as well as the switching during printing, can be performed without interference.

It is yet another object of the present invention to provide a distance setting for printers, where the material to be printed on is solidly held in position during the printing process.

These and other objects and advantages of the present invention will become evident from the description which follows.

2. Brief Description of the Invention

A device for adapting a distance of a print head relative to a thick print material in an office machine comprises a frame, a print surface support attached to the frame, and guide rails attached to the frame running substantially parallel to the print surface support. Furthermore, a print head carriage, supported by the guide rails, can be moved back and forth in parallel to the print surface support between end positions. A print head is disposed on the print-head carriage to be carried by the print head carriage in parallel to a print surface support between end positions. The print head can be set perpendicular with respect to the print surface support against a spring force relative to the print surface support. A bendable strip, running parallel to the print-surface support, rests during the printing process solidly on the thick print material. The bendable strip is disposed in a rest position at a distance running parallel and corresponding to the thickest print material to be printed above the print support. At least one strip end is longitudinally attached to the frame under a tension spring force in the longitudinal directions. Cutouts in the bendable strip are coordinated to defined end position sections. The bendable strip exhibits at least for the length of the cutouts a laterally staggered strip width section. A rotatable roller, supported at the print-head front face, has a running surface and rests on the bendable strip. The print-head carriage can be lifted by the print material in a limited amount at the end positions of the print head carriage over the defined end position sections. The cutouts do not allow a transfer of a support force onto the bendable strip with the running surface of the rotatable roller.

The office machine can be a printer for savings booklets or vouchers.

A ring shoulder of decreased diameter can be disposed on the rotatable roller concentrically to the roller's rotation axis. The width of the ring shoulder can correspond approximately to the width of the laterally staggered strip-width section.

A second roller can be rotatably supported at the print-head carriage. A wedge piece can be attached to the frame with a slope rising toward a respective end of a carriage motion in the path course of the second roller. The wedge piece can be disposed in the defined sections of the end positions with the circumference surface of the second roller to be supported on the slope in the area of the defined end sections.

Stud bolts can be provided on a plane of the print-surface support at the longitudinal distance of the bendable strip. The bendable strip can be hung in the stud bolts. Stud bolts can be provided on a plane of the print-surface support at the longitudinal distance of the bendable strip. The bendable strip can be guided in the stud bolts. A tension spring can connect a bendable strip end to the corresponding stud bolt.

A guide support means can be attached to the frame for supporting one of the guide rails such as to allow the guide rail to move in a direction about perpendicular to the print surface plane.

Elastic means can be attached to the frame and engaging the said guide rail for retaining the print head at a defined distance relative to the print surface.

Guide support means can be attached to the print head carriage and engage a second one of the guide rails for supporting the print head carriage while allowing motion of the print head in a direction perpendicular to the print surface. The guide support means can include two substantially parallel bars running perpendicular to the print surface at a distance corresponding to about the outer diameter of the said second guide rail in the direction of engagement with the parallel bars.

A method for adapting the position of a print head relative to a thick print material in an office machine comprises the steps of moving the print head carriage near to an end position with the second roller moving up the slope of the wedge. A thick printing material is placed under the bendable strip while the first roller is disposed in the cutout of the bendable strip. The print head carriage is activated to move such that the second roller rolls over the slope of the wedge and such that the first roller engages the bendable strip. The bendable strip is pressed down onto the material to be printed on with the first roller, with the print head following the first roller and thereby obtaining a proper positioning relative to the material to be printed on.

The invention provides that a bendable strip is disposed above the print-surface support at a parallel distance corresponding to the thickest print material. The bendable strip is movable in the longitudinal direction and attached at least at one strip end under spring-tension force. The print-head carriage can be lifted up in sections of its end positions limited by the print material. In these end position sections, cutout sections are disposed in the bendable strip. No support force can be transferred to the bendable strip in the cutout sections with the rotatable roller on its running surface. The bendable strip exhibits, at least over the length of the cutout sections, a laterally staggered strip-width section. The bendable strip is lifted up in the end positions of the print-head carriage such that also print material of a thickness of several millimeters can be inserted without disturbance and that the line-feed switching can run without problems and without the occurrence of interferences based on the provision of cutout sections in the end position sections, where the rotatable roller can submerge in the cutout section.

According to a further feature of the invention, it is possible to further enlarge the distance of the bendable strip relative to the plane of the print-surface support by providing the rotatable roller with a ring shoulder of a decreased diameter disposed concentrically to the rotation axis of the rotatable roller. The width of the ring shoulder corresponds approximately to the width of the laterally staggered strip-width section. Thereby, not only a distance increase is achieved but, simultaneously, the strip distance is precisely limited in the end positions of the print-head carriage to achieve an adjustment to the thickest print material and to allow for sufficient space for insertion and feed switching of the line-feed switching.

The lifting of the print-head carriage occurs, according to further features of the invention, by rotatably supporting a second roller at the print-head carriage, where, in each case, an increasing slope is disposed in the direction of the motion in the sections of the end positions of the carriage, where the circumference of the second roller can be supported in the end sections on the increasing slope.

Advantageously, the bendable strip is attached by providing on the plane of the print-surface support spacer bolts and/or stud bolts at a longitudinal distance corresponding to about the length of the bendable strip, where the bendable strip can be hung into or, respectively, guided along the spacer bolts and/or stud bolts.

The longitudinal motion of the bendable strip can be achieved by connecting one strip end to the respective stud bolt via a tension spring.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
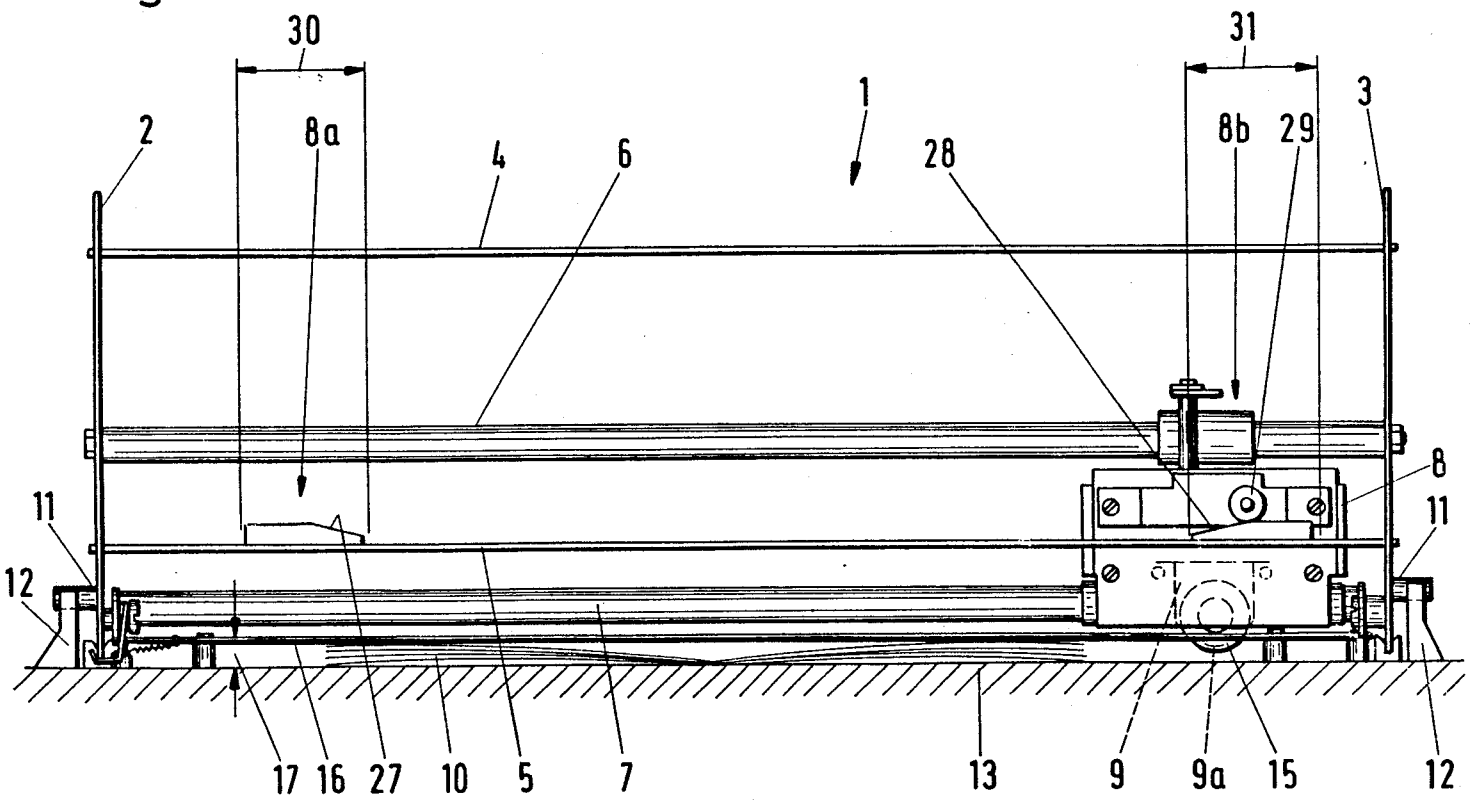
FIG. 1 is a front elevational view of the printer frame of a multiple-form printer, such as for savings booklets or vouchers.

In accordance with the invention, there is provided a device for the setting of a distance of a print head on a thick print material in an office machine, in particular in a printer for savings booklets or vouchers. The print head can be moved back and forth on a print-head carriage in parallel to a print surface support between end positions and can be set perpendicular with respect to the print support against a spring force relative to the print-surface support. At least one rotatable roller, supported at the print-head front face, rests on a bendable strip running parallel to the print-surface support. The bendable strip rests during the printing process solidly on the thick print material. The bendable strip 16 is disposed at a distance 17 running parallel and corresponding to the thickest print material 10 to be printed above the print support 13. At least one strip end **16*a* is longitudinally attached under a tension spring force in the longitudinal direction 18. The print-head carriage 8 can be lifted in a limited way by the print material 10 in the end positions 8*a*, 8*b* of the print head carriage 8 in sections 30, 31. Cutout sections 32, 33 are coordinated to these end position sections 30, 31 in the bendable strip 16. The cutout sections 32, 33 do not allow a transfer of a support force onto the bendable strip 16 from the rotatable roller's running surface 15*a*. The bendable strip 16 exhibits, at least for the length of the cutout sections 32, 33, a laterally staggered strip width section 34**.

The rotatable roller 15 can exhibit, concentrically to its rotation axis 35, a ring shoulder 37 of decreased diameter 36. The width 38 of the ring shoulder 37 can correspond approximately to the width 39 of the laterally staggered strip-width section 34.

A second roller 29 can be rotatably supported at the print-head carriage 8. In the path course of the second roller 29, in each case, a slope 27, 28, increasing in the direction of motion, can be disposed in the sections 30, 31 of the end positions 8a, 8b. The circumference 29a of the second roller 29 can be supported on the increased slope 27, 28 in the end sections 30, 31.

Preferably, stud bolts 20, 21, 22, 23 are provided on the plane 13a of the print-surface support 13 at the longitudinal distance of the bendable strip 16. The bendable strip 16 can be hung or, respectively, guided in the stud bolts 20, 21, 22, 23. A strip end 16a can be connected to the corresponding stud bolt 20 via a tension spring 19.

Figure 2:
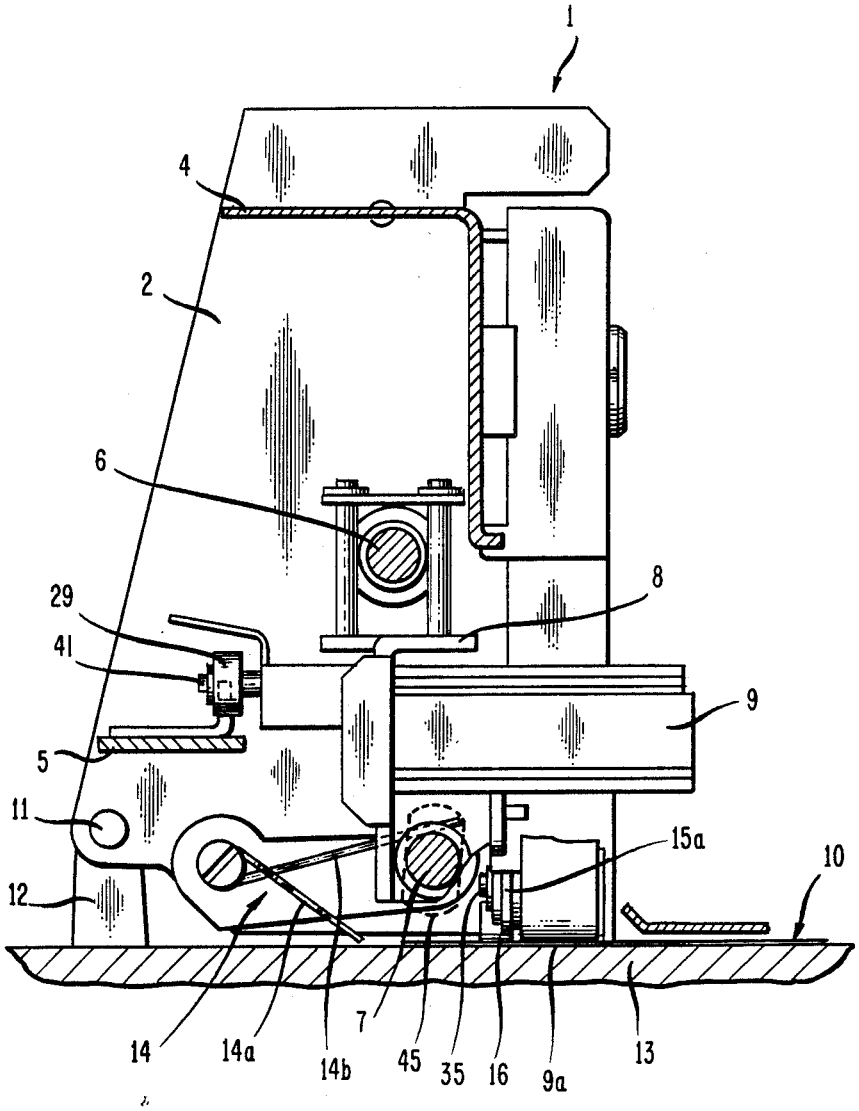
FIG. 2 is a slightly increased side view of the printer frame according to FIG. 1.

A multiple-form printer as an example of an office machine operating as a printer comprises a printer frame 1, which includes side plates 2 and 3, cross rails 4 and 5, as well as carriage guide axles 6 and 7 for a print-head carriage 8. The carriage guide axle 6 is supported at its ends such as to be capable of moving in a direction perpendicular to the print surface support 13 by a guide means disposed at the side plates 2, 3. This can be achieved by providing a slot 45 directed substantially perpendicular to the surface of the print material, wherein the carriage guide axle 7 can guidedly move. A spring or an elastic retaining means 14 can be furnished which holds the carriage guide axle 7 toward the print material surface. The print-head carriage 8 is movable in a direction perpendicular to the print surface supported by the carriage guide axle 6. In addition, the support of the print-head carriage 8 on the carriage guide axle 6 can be a tiltable support. This can be achieved by attaching two parallel bars to the print-head carriage 8, which bars are positioned in parallel and held at their two ends mechanically at a required distance. The distance between the two bars is such that they slide on the carriage guide axle 6. The cross-section of the carriage guide axle 6 can vary and can be round, elliptical, or rectangular as desired for providing a matching sliding support to the parallel bars attached to the print-head carriage 8. The print-head carriage 8 carries a print head 9, where such an arrangement of a printer frame 1 for a thick print material 10 is hingedly supported in a bearing block pair 12 for tilting around a horizontal axis 11, as shown in FIG. 2. The thick print material 10, illustrated in FIGS. 1 and 2, comprises savings booklets, multiple-layer vouchers, and the like. The embodiment includes a horizontal print surface support 13. A spring clip or leg spring 14 is attached at the printer frame 1. The legs 14a and 14b of the leg spring 14 are supported at the printer frame 1 or, respectively, at the print-head carriage 8 such that the print-head carriage 8 exhibits the tendency to move with one roller 15 always in the direction toward the print-surface support 13. This tendency can also be created in case of a more vertical position of the print-surface support 13, provided for example as a plate, and the leg spring 14 can also be formed as a compression spring or as a tension spring. The roller 15, rotatably supported at the print-head front face 9a, rests on a bendable strip 16 made of metal such as, for example, spring steel and preferably cold-rolled carbon spring steel, which can contain more than 0.1 weight-percent chromium, and preferably from about 5 to 10 weight-percent chromium, and which strip runs parallel to the print-surface support 13 and, in fact, close next to the print-head front face 9a, in order to maintain the print material 10 in the area of the print location at a constant distance to the print-head front face 9a. This distance is of importance in connection with the print-pin stroke.

The strip can be formed as a flat piece of steel which, over most of its inner part of its length, is of constant diameter. Towards the ends, a cutout section is provided which is disposed in a continuation of the inner extension of the strip. In the area of this cutout section, the strip is continued on the side of this cutout section and preferably on both sides of both end sections of the strip, the cutout and the parallel-running strip width are provided in a mirror-symmetrical fashion relative to a plane perpendicular to the longitudinal extension of the strip. At the outside end of the cutout, the strip preferably assumes a width which corresponds to about the sum of the width of the strip in the middle section and the width of the strip in the cutout section. The end section is preferably provided with an inner slot running in longitudinal direction, where the inner slot at one end is extended to a hole allowing passing of the head of a retaining means, such as a screw. Furthermore, the end faces of the strip are provided with a cutout slot which allows the strip to be positioned below the head of a retaining means, such as a screw. The slots are provided for allowing longitudinal motion of the strip. The hole opening can further serve as an attachment point for a tension spring. The retaining means are preferably mounted on stud bolts 20, 21, 22, 23. The second end of the tension spring 19 is preferably attached to the stud bolt 20. The strip can have a width in the area of the cutout sections 32 and 33 and the laterally staggered width section 34 which is from about 1.5 to 3 times the width of the strip in its middle section. The strip can have a width which is from about 5 to 20 times its thickness. The height of the stud bolts corresponds to the thickness of the thickest material to be employed. The height of the stud bolts can be from about 2 to 4 times the width of the strip in its middle section. The width of the slots can be from about 0.5 to 0.8 the width of the strip in its middle section.

The thickest print material 10 to be processed in the office machine now determines a distance 17 running parallel to the print-surface support 13, where the print material 10, for example a savings booklet, can be easily slid under the strip 16 or, respectively, where, in the end positions 8a and 8b, the print material 10 or the print head 9 can be advanced and shifted by a line-advance step. The print-head carriage is disposed, according to the embodiment of FIG. 1, in the right end position 8b.

Figure 3:
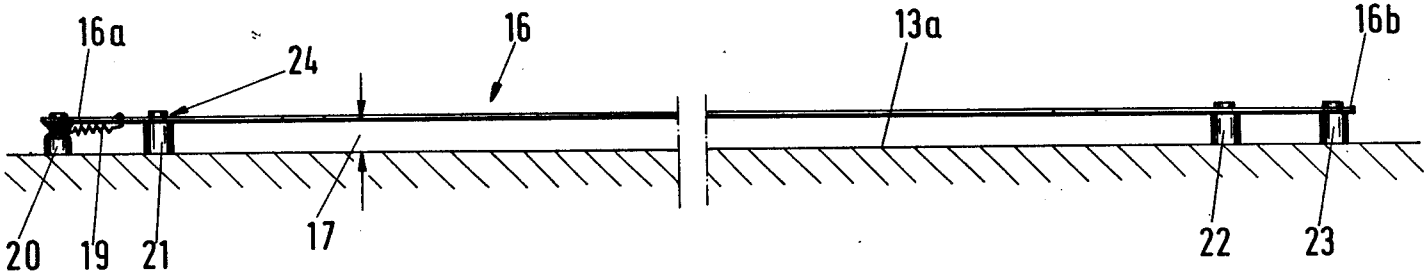
FIG. 3 is a side elevational view of the bendable strip shown by itself.
Figure 4:
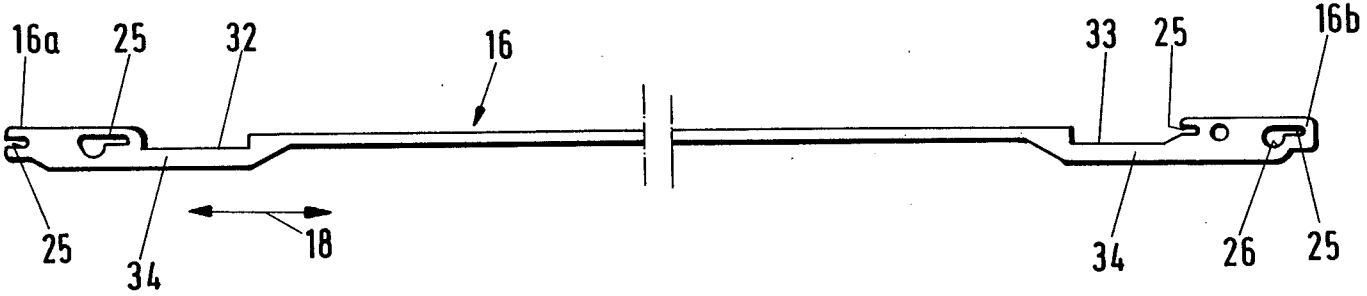
FIG. 4 is a top view onto the bendable strip according to FIG. 3.

The strip 16, as illustrated in FIGS. 3 and 4, is subjected at least with one strip end 16a in the longitudinal direction 18 to the force of a tension spring 19 and is slidably supported in the longitudinal directions. The support comprises spacer bolts or stud bolts 20, 21, 22, and 23 attached about at the plane 13a of the print-surface support 13, where the stud bolts are provided in each case with ring-cutout sections 24, in which the slots 25 of the strip 16 are guided. The slots 25 can be open at one side or they can form part of a cutout or opening 26, formed about like a keyhole, for hanging of the strip 16, for example, at the strip end 16b.

Figure 5:
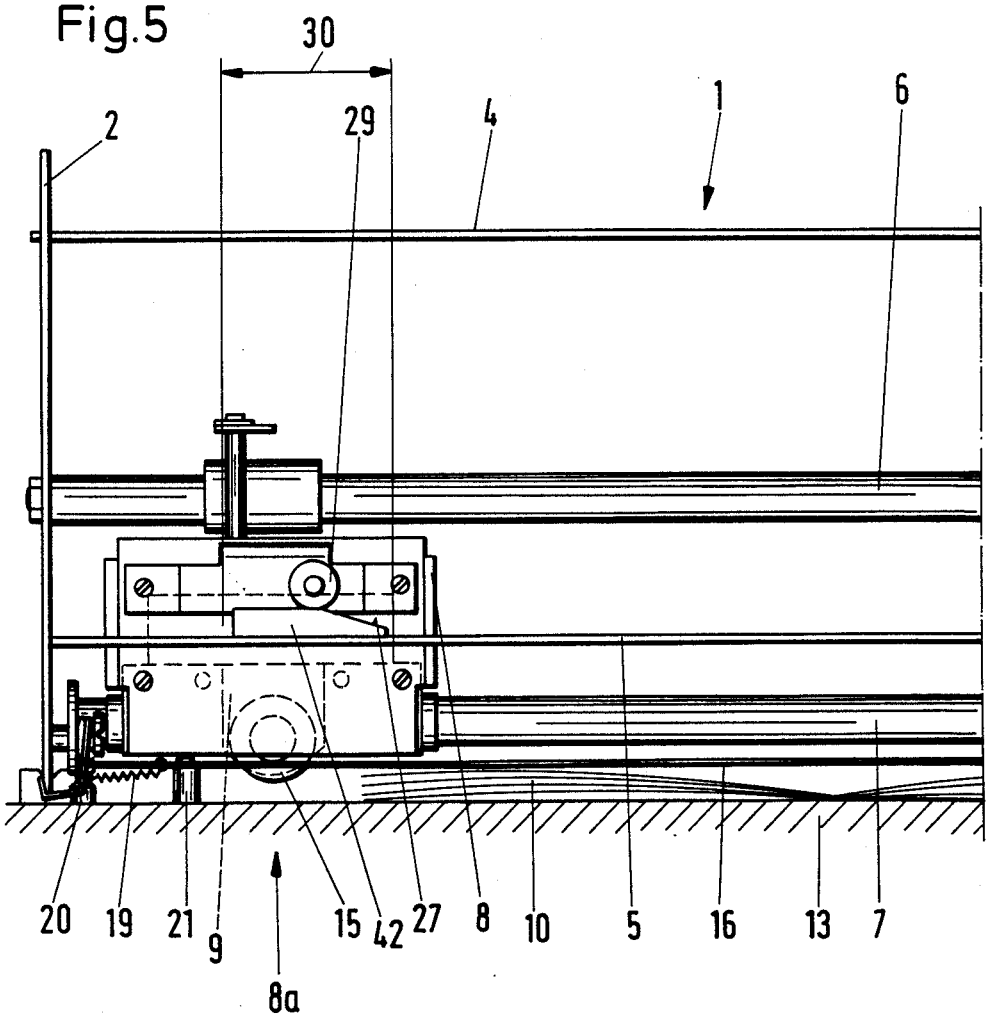
FIG. 5 is a partial front elevational view of the printer frame, where the print-head carriage is disposed at a left end position.
Figure 7:
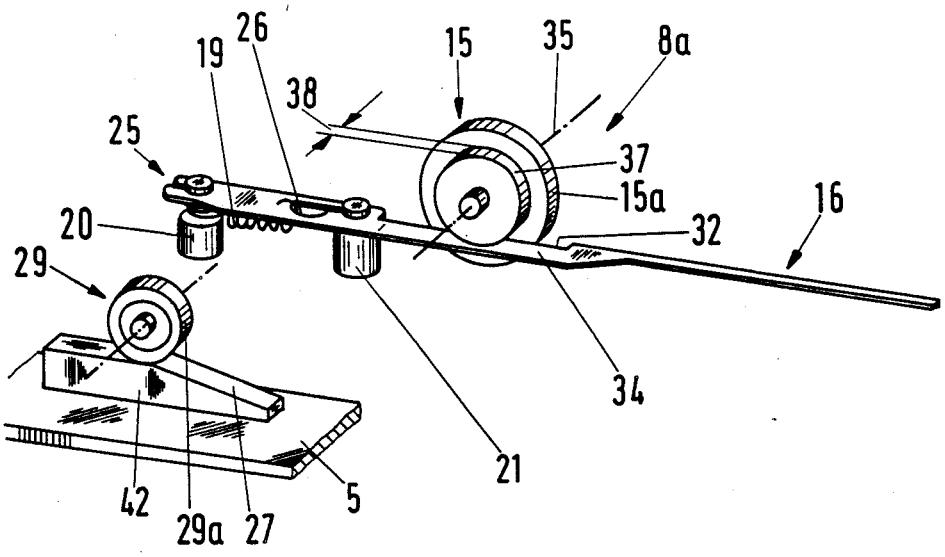
FIG. 7 is a perspective partial representation of the bendable strip with the print-head roller and the second roller at the print-head carriage, corresponding to the state illustrated in FIG. 5.
Figure 8:
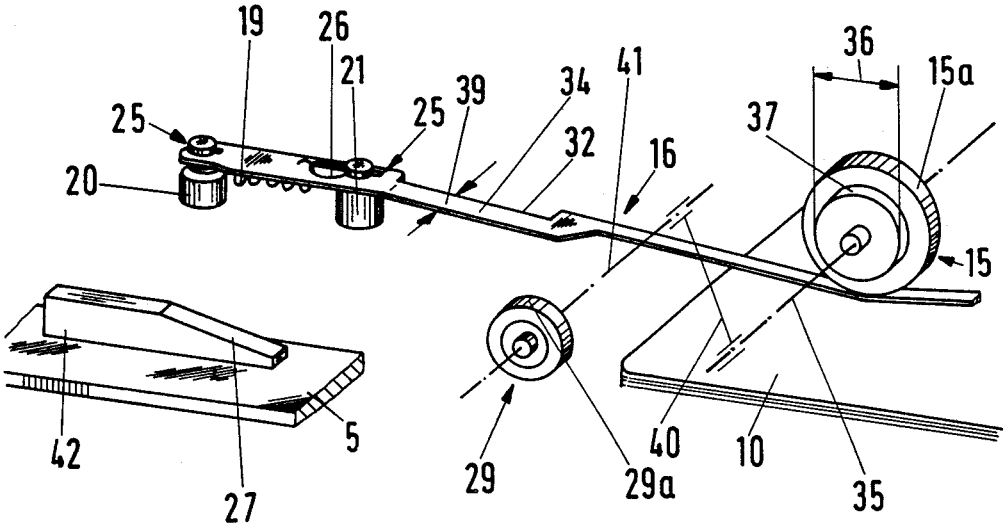
FIG. 8 is a perspective partial representation of the bendable strip with the print-head roller and the second roller at the print-head carriage, corresponding to the state illustrated in FIG. 6.

The print-head carriage 8 can be lifted via inclined slopes 27 and 28 and a second roller 29 rotatably supported at the print-head carriage 8 and, in fact, in horizontal end position sections 30 and 31 which can be of about the same length as the inclined slopes 27 and 28. Cutout sections 32 and 33, as illustrated in FIG. 4, are provided in these sections 30 and 31 of the end positions 8a or, respectively, 8b of the print-head carriage 8 disposed in the bendable strip 16. The rotatable roller 15 does no longer find any support with its running surface 15a on the bendable strip 16 in the area of the cutout sections 32 and 33, as illustrated in FIG. 1: end position 8b; FIG. 5: end position 8a, and FIG. 7: end position 8a. This means that the strip 16 is no longer subjected to the contact pressure of the roller 15 as soon as the print-head carriage 8 passes into one of the end positions 8a and 8b, and the spring force in the strip 16 induces the strip 16 to spring up and bounce up. This motion can now be limited by providing the bendable strip 16, in the region of the cutout sections 32 and 33, with a laterally staggered strip-width section 34 and the rotatable roller 15 is provided, concentrically to its running surface 15a on its rotation axis 35, with a ring-section shoulder 37 of a decreased diameter 36, as illustrated in FIG. 8. The width 38 of the ring-section shoulder corresponds approximately to the width 39 of the laterally staggered strip-width section 34. Thus, the second roller 29 can be supported via its circumference 29a on the inclined slopes 27 or, respectively, 28 in the end sections 30 and 31, and while thereby a lifting of the print-head carriage 8 together with the roller 15 is performed, which corresponds however only to the height-level difference of the inclined slope 27 or, respectively 28, such that the tension force of the strip 16 generates a gap based on the tension force inherent in the strip 16 which slot can have a width practically from, for example, about 2 to 6 mm, and preferably from about 3 to 5 mm, such as for example 4 mm, between the print material 10 and the strip 16. The ring shoulder 37 effects an additional lifting of the strip 16, however, with a lifting height limitation based on the relatively smaller diameter 36. An imaginary line 40 in FIG. 8 indicates that the axis 35 of the roller 15 and the rotation axis 41 of the second roller 29 are rigidly disposed at the print-head carriage 8.

Figure 6:
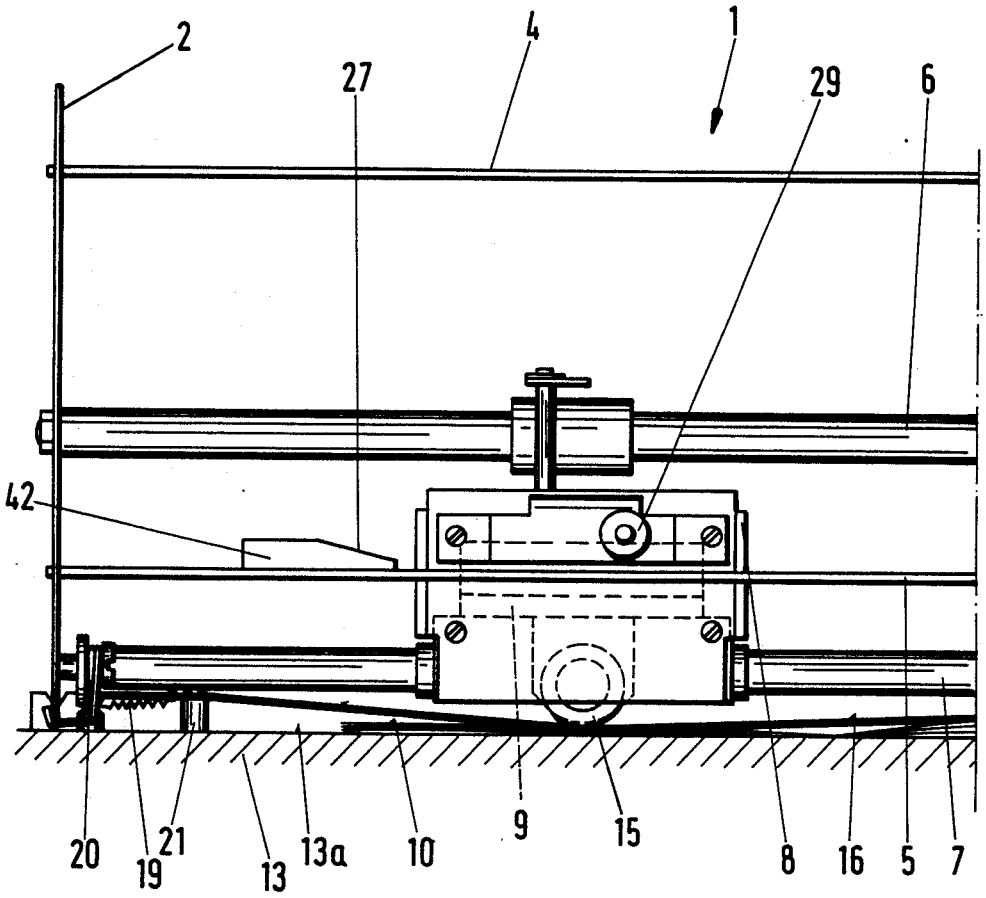
FIG. 6 is a partial front elevational view of the embodiment of FIG. 5, where the print-head carriage is however in printing motion.

The print-head carriage 8 in addition is disposed in the end position 8a of FIG. 5, where the second roller 29 just starts to move upon motion toward the right of the print-head carriage 8 on the inclined slope 27, which is part of the wedge piece 42, which is attached on the cross rail 5 in the end sections 30 or, respectively, 31. After leaving the inclined slope 27, the running surface 15a again contacts and engages also the strip 16 and presses this strip 16, as illustrated in FIG. 6, downward onto the print material 10, such that it is possible to print with the print head 9.

It will be understood that each of the elements described above, or two or more together, may also find a useful application in other types of devices for the adjustment of the distance differing from the types described above.

While the invention has been illustrated and described as embodied in the context of a distance adjuster for a print head of an office machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for adapting a distance of a print head relative to a thick print material in an office machine comprising a frame;

a print surface support attached to the frame;

guide rails attached to the frame running substantially parallel to the print surface support;

a print head carriage supported by the guide rails so that the print head carriage can be moved back and forth in parallel to the print surface support between end positions; a print head disposed on the print-head carriage to be carried by the print head carriage in parallel to a print surface support between defined end sections, where the print head can be set perpendicular with respect to the print surface support against a spring force relative to the print surface support;

a bendable strip running parallel to the print-surface support, where the bendable strip rests during the printing process solidly on the thick print material, wherein the bendable strip is disposed in a rest position at a distance running parallel and corresponding to the thickest print material to be printed above the print support, where at least one strip end is longitudinally attached to the frame under a tension spring force in the longitudinal directions, where cutout sections in the bendable strip are disposed near the defined end position sections and wherein the bendable strip exhibits at least for the length of the cutout sections a laterally staggered strip width section;

a rotatable roller supported on the print-head carriage, which roller has a running surface and which roller rests on the bendable strip, where the print-head carriage can be lifted by the print material in a limited amount at the end positions of the print head carriage over the defined end position sections, and where the cutout sections do not allow a transfer of a support force onto the bendable strip with the running surface of the rotatable roller.

2. The device for adapting a distance of a print head according to claim 1 wherein the office machine is a printer for savings booklets or vouchers.

3. The device for adapting a distance of a print head according to claim 1 further comprising a ring shoulder of decreased diameter disposed on the rotatable roller concentrically to the roller's rotation axis where the width of the ring shoulder corresponds approximately to the width of the laterally staggered strip-width section.

4. The device for adapting a distance of a print head according to claim 1 further comprising a second roller rotatably supported on the print-head carriage;

a wedge piece, attached to the frame with a slope rising toward a respective end of a carriage motion in the path course of the second roller, disposed in the defined sections of the end positions, with the circumference surface of the second roller to be supported on the slope in the area of the defined end sections.

5. The device for adapting a distance of a print head according to claim 1 further comprising stud bolts provided on a plane of the print-surface support at the longitudinal distance of the bendable strip, where the bendable strip is hung in the stud bolts.

6. The device for adapting a distance of a print head according to claim 1 further comprising stud bolts provided on a plane of the print-surface support at the longitudinal distance of the bendable strip where the bendable strip is guided in the stud bolts.

7. The device for adapting a distance of a print head according to claim 1 wherein a tension spring provides the tension spring force and connects a bendable strip end to the corresponding stud bolt and wherein the strip is slidably supported in a longitudinal direction.

8. The device for adapting a distance of a print head according to claim 1 further comprising a guide support means attached to the frame for supporting one of the guide rails such as to allow the guide rail to move in a direction about perpendicular to the print surface plane.

9. The device for adapting a distance of a print head according to claim 8 wherein elastic means provides the spring force and is attached to the frame and engages the said guide rail for retaining the print head at a defined distance relative to the print surface.

10. The device for adapting a distance of a print head according to claim 1 further comprising guide support means attached to the print head carriage and engaging one of the guide rails for supporting the print head carriage while allowing motion of the print head in a direction perpendicular to the print surface.

11. The device for adapting a distance of a print head according to claim 10 wherein the guide support means includes two substantially parallel bars running perpendicular to the print surface at a distance corresponding to about the outer diameter of the said second guide rail in the direction of engagement with the parallel bars.

12. A device for the setting of a distance of a print head on a thick print material in an office machine, where the print head can be moved back and forth on a print-head carriage in parallel to a print surface support between end positions and can be set perpendicular with respect to the print support against a spring force relative to the print-surface support, with at least one rotatable roller supported at the print-head front face, which roller rests on a bendable strip running parallel to the print-surface support, where the bendable strip rests during the printing process solidly on the thick print material, wherein the bendable strip (16) is disposed at a distance (17) running parallel and corresponding to the thickest print material (10) to be printed above the print support (13), where at least one strip end (16*a*) is longitudinally attached under a tension spring force in the longitudinal directions (18), where the print-head carriage (8) can be lifted in a limited way (10) in end position sections (30, 31) of the end positions (8*a*, 8*b*) of the print head carriage (8) for allowing positioning of print material, where cutout sections (32, 33) are disposed near these end position sections (30, 31) in the bendable strip (16), where the cutout sections (32, 33) do not allow a transfer of a support force onto the bendable strip (16) with the rotatable roller (15) having a running surface (15*a*), and wherein the bendable strip (16) exhibits, at least for the length of the cutout sections (32, 33), a laterally staggered strip width section (34).

13. A device according to claim 12, wherein the rotatable roller (15) exhibits, concentrically to its rotation axis (35), a ring shoulder (37) of decreased diameter (36), where the width (38) of the ring shoulder (37) corresponds approximately to the width (39) of the laterally staggered strip-width section (34).

14. A device according to claim 12, wherein a second roller (29) is rotatably supported at the print-head carriage (8), wherein each end position of the path of the second roller has a slope engaged by the second roller which serves as means for lifting the carriage from the print material, where the circumference (29*a*) of the second roller (29) can be supported on the slope (27, 28) in the end sections (30, 31).

15. A device according to claim 12, wherein stud bolts (20, 21, 22, 23) are provided on the plane (13*a*) of the print-surface support (13) at the longitudinal distance of the bendable strip (16), where the bendable strip (16) is guided in the stud bolts (20, 21, 22, 23).

16. Device according to claim 15, wherein a strip end (16*a*) is connected to the corresponding stud bolt (20) via a tension spring (19) furnishing the tension spring force in the longitudinal directions.

17. A method for adapting the position of a print head relative to a thick print material in an office machine wherein the office machine comprises a frame;

a print surface support attached to the frame;

guide rails attached to the frame running substantially parallel to the print surface support;

a print head carriage supported by the guide rails where the print head carriage can be moved back and forth in parallel to the print surface support between end positions;

a print head disposed on the print-head carriage to be carried by the print head carriage in parallel to a print surface support between end positions, where the print head can be set perpendicular with respect to the print surface support against a spring force relative to the print surface support;

a bendable strip running parallel to the print-surface support, where the bendable strip rests during the printing process solidly on the thick print material, wherein the bendable strip is disposed at a distance running parallel and corresponding to the thickest print material to be printed above the print support, where at least one strip end is longitudinally attached to the frame under a tension spring force in the longitudinal directions, where cutout sections in the bendable strip are coordinated to defined end position sections and wherein the bendable strip exhibits at least for the length of the cutout sections a laterally staggered strip width section;

a rotatable roller supported at the print-head carriage, which roller has a running surface and which roller rests on the bendable strip, where the print-head carriage can be lifted by the print material in a limited amount at the end positions of the print head carriage over the defined end position sections, and where the cutout sections do not allow a transfer of a support force onto the bendable strip with the running surface of the rotatable roller;

a second roller rotatably supported at the print-head carriage;

a wedge piece attached to the frame with a slope rising toward a respective end of a carriage motion in the path course of the second roller is disposed in the defined sections of the end positions with the circumference surface of the second roller to be supported on the slope in the area of the defined end sections;

comprising the steps moving the print head carriage near to an end position with the second roller moving up the slope of the wedge together with the print head carriage;

placing a thick printing material under the bendable strip while the first roller is disposed in the cutout section of the bendable strip;

activating the print head carriage to move such that the second roller together with the print head carriage rolls over the slope of the wedge and such that the first roller engages the bendable strip;

pressing the bendable strip down onto the material to be printed on with the first roller, with the print head carriage following the first roller and thereby obtaining a proper positioning relative to the material to be printed on;

printing with the print head onto the material;

releasing the pressing of the bendable strip for disengaging the bendable strip from the material to be printed on; advancing the material to be printed on to a further print on position.

18. A method for adapting the position of a print head relative to a thick print material in an office machine wherein the office machine comprises a frame;

a print surface support attached to the frame;

guide rails attached to the frame running substantially parallel to the print surface support;

a print head carriage supported by the guide rails where the print head carriage can be moved back and forth in parallel to the print surface support between end positions;

a print head disposed on the print-head carriage to be carried by the print head carriage in parallel to a print surface support between end positions, where the print head can be set perpendicular with respect to the print surface support against a spring force relative to the print surface support;

a bendable strip running parallel to the print-surface support, where the bendable strip rests during the printing process solidly on the thick print material, wherein the bendable strip is disposed at a distance running parallel and corresponding to the thickest print material to be printed above the print support, where at least one strip end is longitudinally attached to the frame under a tension spring force in the longitudinal directions, where cutout sections in the bendable strip are coordinated to defined end position sections and wherein the bendable strip exhibits at least for the length of the cutout sections a laterally staggered strip width section;

a rotatable roller supported at the print-head carriage, which roller has a running surface and which roller rests on the bendable strip, where the print-head carriage can be lifted by the print material in a limited amount at the end positions of the print head carriage over the defined end position sections, and where the cutout sections do not allow a transfer of a support force onto the bendable strip with the running surface of the rotatable roller; a second roller rotatably supported at the print-head carriage;

a wedge piece attached to the frame with a slope rising toward a respective end of a carriage motion in the path course of the second roller is disposed in the defined sections of the end positions with the circumference surface of the second roller to be supported on the slope in the area of the defined end sections;

comprising the steps moving the print head carriage near to an end position with the second roller and the print head carriage moving up the slope of the wedge; placing sheet material under the bendable strip while the first roller is disposed in the cutout section of the bendable strip;

activating the print head carriage to move such that the second roller and the print head carriage rolls over the slope of the wedge and such that the first roller engages the bendable strip;

pressing the bendable strip down onto the material to be printed on with the first roller, with the print head carriage following the first roller and thereby obtaining a proper positioning relative to the material to be printed on.

19. The method for adapting the position of a print head according to claim 18 further comprising printing with the print head onto the material;

releasing the pressing of the bendable strip for disengaging the bendable strip from the material to be printed on.

20. The method for adapting the position of a print head according to claim 18 further comprising advancing the material to be printed on to a further print on position.

* * * * *